United States Patent [19]

Kishida et al.

[11] Patent Number: 5,049,063

[45] Date of Patent: Sep. 17, 1991

[54] COMBUSTION CONTROL APPARATUS FOR BURNER

[75] Inventors: Teruhiko Kishida; Syuji Iida; Kazunari Hosome; Kazuya Tomatu; Tosizi Tachibana, all of Toyota, Japan

[73] Assignee: Toyota Jidosha Kabushiki Kaisha, Japan

[21] Appl. No.: 456,478

[22] Filed: Dec. 26, 1989

[30] Foreign Application Priority Data

Dec. 29, 1988 [JP] Japan ..... 63-334619
Mar. 27, 1989 [JP] Japan ..... 1-74623
May 17, 1989 [JP] Japan ..... 1-123892

[51] Int. Cl.[5] ..... F23N 5/00
[52] U.S. Cl. ..... 431/78; 431/79; 431/63; 431/25
[58] Field of Search ..... 431/25, 63, 78, 79

[56] References Cited

U.S. PATENT DOCUMENTS 2,537,293 1/1951 Peterson ..... 431/59
4,410,266 10/1983 Seider ..... 431/79

FOREIGN PATENT DOCUMENTS 306310 12/1988 Japan ..... 431/79

*Primary Examiner*—Carroll B. Dority
*Attorney, Agent, or Firm*—Finnegan, Henderson, Farabow, Garrett & Dunner

[57] ABSTRACT

A combustion control apparatus for a burner comprising a detector for detecting an ionic current in a flame from the burner or light power of the flame, which changes in accordance with a change of combustion condition of the flame, and outputting an electric signal corresponding to the detected ionic current or light power, and an electric circuit supplied with the signal output from the detector to generate an output for maintaining a predetermined combustion condition on the basis of a reference value previously set therein and deliver the output to a controller for fuel and air systems of the burner.

2 Claims, 19 Drawing Sheets

COMBUSTION CONTROL APPARATUS FOR BURNER0

BACKGROUND OF THE INVENTION

1. Field of the Invention

The present invention relates to a combustion control apparatus for a burner used in a boiler or other combustion facilities, which is arranged to detect a combustion condition of a flame generated from the burner on the basis of the ionic current or light of the flame, process the detected signal in an electrical circuit and then control the fuel and air flow rates to preset values, thereby maintaining the combustion in the best condition.

2. Prior Art

It is preferable that burners for burning liquid or gas fuel be maintained in an optimal combustion condition. Prior arts contrived to maintain these burners in an optimal combustion condition include a method wherein the combustion control of a burner is affected on the basis of a signal obtained by detecting an ionic current which is generated between an electrode provided so as to extend into the tip portion of a flame generated from the burner and a terminal provided on the flame radiating portion of the burner and passing the detected ionic current through a frequency analyzer or other similar circuits, and a method wherein the combustion control of a burner is affected by use of a photosensor which is provided at a position where the flame can be monitored to detect vibration of light, which is then converted into an electric signal and amplified to detect a combustion condition of the flame by means of a frequency analyzer or other similar circuits.

Of the two methods, the combustion condition detecting method that employs the ionic current will first be explained.

The change of the ionic current with respect to the time axis in a certain combustion condition shows an oscillating waveform such as that shown in FIG. 5. In the aforementioned prior art, the oscillating waveform is input to a frequency analyzer to obtain a power spectrum such as that shown in FIG. 6. The power spectrum changes in accordance with a change in the air-fuel ratio, as shown in FIG. 6. Therefore, it has heretofore been a general practice to obtain an integral ratio of the power spectrum in a specific frequency band to that in the entire frequency band, as shown in FIG. 13, obtain a proportional relation of the $O_2$ content in exhaust gas and the integral ratio (power spectrum ratio) as shown in FIG. 14, and execute combustion control by using the power spectrum ratio as an index in place of the $O_2$ content (%).

One example of the conventional method that employs a photosensor comprises the steps of: detecting a light power signal from the flame; obtaining a signal representative of the amplitude of the light power from the light power signal; subjecting the thus obtained signal to frequency analysis to obtain a power spectrum; detecting a combustion condition from the power spectrum signal; comparing the detected combustion condition with an optimal combustion condition to obtain a deviation; and controlling a flow controller for combustion air so that the deviation is eliminated. In this method, a semiconductor photosensor, for example, a phototransistor, photodiode, solar cell, etc., is used as a means for detecting a signal representative of the intensity of light emitted from the burner flame.

This method will be explained below more specifically. In a prior art combustion control apparatus shown in FIG. 25, a light power signal a which is representative of the light intensity of a burning flame 3 from a burner 2 provided in a furnace 1 is detected by means of a photosensor 4. The light power signal a is input to a frequency analyzer 7 through a detector 5 and an amplifier 6. The frequency analyzer 7 carries out frequency analysis on the basis of the light power signal a to compute a power spectrum d and outputs it to a light power oscillation controller 8.

The light power oscillation controller 8 computes an integral value J of the power spectrum d in the entire frequency band and an integral value K in a frequency band higher than a specific frequency and divides the integral value K by the integral value J to obtain a power spectrum integral ratio C. The specific frequency is, for example, set as follows: The rate of change of the power spectrum may vary at both sides of a boundary frequency in accordance with the change of the excess air ratio; therefore, such a boundary frequency is, for example, defined as a specific frequency. Further, in expectation that the power spectrum integral ratio C is in approximately proportional relation to the excess air ratio under given conditions, this relation is utilized to control the flow rate of the combustion air 10 by outputting a compensation signal f to a compensator 9 so that the power spectrum integral ratio C is equal to a preset reference value, thereby obtaining a good combustion condition. Temperature controller 17 is provided above compensator 9 and is supplied with a signal from the thermometer 18 and a signal from flow meter 15.

The above-described conventional method wherein the combustion control of a burner is affected on the basis of an ionic current signal detected from the flame has the problems that the combustion condition of the burner is affected by a change in the flame condition caused by the way in which the burner is disposed in the furnace or the flame touching an object to be heated.

Accordingly, it is an object of the invention of this application to provide a control apparatus which is capable of avoiding such adverse effects on the combustion of the burner.

It is another object of the present invention to solve problems experienced when employing the above-described conventional method wherein the combustion control of a burner is affected by sensing the light from the burner flame by means of a photosensor. More specifically, the prior art method suffers from the following problems.

It may be impossible to obtain a high rate of change of the power spectrum integral ratio C, depending upon the arrangements of the furnace and burner.

In the case of an industrial furnace such as that shown in FIG. 26, for example, a heat-insulating wall 11 made from a refractory bricks, etc. is provided on the inner wall portion of the furnace 1 and this heat-insulating wall 11, when heated to high temperature, greatly affects the flame 3 by radiant heat, so that the rate of change of the integral ratio C decreases. For instance, if heavy oil A is burned in the furnace 1 having the heat-insulating wall 11 at 60 l/h and with various excess air ratios, i.e., 1.62, 1.31, 1.17 and 1.05, and the combustion condition is examined by frequency analysis, it is revealed that the highest frequency (about 400 Hz in this example) in the power spectrum d has substantially no change irrespective of the difference in the excess air ratio, as shown in FIG. 27, and consequently the rate of change of the power spectrum integral ratio C obtained is extremely small, as shown in FIG. 28. For this reason, even if such a combustion control apparatus is used for the industrial furnace shown in FIG. 26, it is impossible to satisfactorily control the flow rate of the air 10.

SUMMARY OF THE INVENTION

The combustion control apparatus for a burner according to the present invention comprises: a detector for detecting an ionic current in a flame from the burner or light power of the flame, which changes in accordance with a change of combustion condition of the flame, and outputting an electric signal corresponding to the detected ionic current or light power; and an electric circuit supplied with the signal output from the detector to generate an output for maintaining a predetermined combustion condition on the basis of a reference value previously set therein and deliver the output to a controller for fuel and air systems of the burner.

According to another mode of carrying out the present invention, there is provided a combustion control apparatus for a burner comprising: a detector for detecting an ionic current generated between two electrodes provided in a flame from the burner; a frequency analyzer connected to the detector through an amplifier; an ionic current oscillation controller connected to the frequency analyzer to receive a power spectrum signal obtained by the frequency analyzer; an air flow compensator connected to the ionic current oscillation controller to compare the signal from the ionic current oscillation controller with data representative of an optimal combustion condition which has previously been stored therein, thereby obtaining a deviation, and generate a signal which eliminates the deviation; and a flow control valve connected to the air flow compensator to affect flow control of air.

According to still another mode of carrying out the present invention, there is provided a combustion control apparatus for a burner comprising: a photosensor for detecting a light power signal from a flame generated from the burner; a low-pass filter for cutting off a component of the light power signal detected by the photosensor which is above a specific frequency to obtain a low-frequency light power signal; a frequency analyzer for frequency-analyzing the low-frequency light power signal obtained through the low-pass filter to obtain a power spectrum; arithmetic means for computing an integral value of the power spectrum in the entire frequency band and an integral value of the power spectrum in a frequency band above a preset reference frequency, computing a power spectrum integral ratio from these integral values, comparing the power spectrum integral ratio with a reference integral ratio previously set in correspondence with each particular excess air ratio, and outputting data representative of the result of the comparison; and air flow control means for controlling an air supply control valve of the burner on the basis of the comparison data.

According to a further mode of carrying out the present invention, there is provided a combustion control apparatus for a burner comprising: a detector for detecting an ionic current in a flame from the burner or light power of the flame, which changes in accordance with a change of combustion condition of the flame, and outputting an electric signal corresponding to the detected ionic current or light power; an amplifier for amplifying the electric signal; a low-pass filter connected to the output side of the amplifier to remove a high-frequency component in the electric current; a first circuit connected to one of the two branch lines connected to the output side of the low-pass filter to rectify the signal current having passed through the low-pass filter and thereby obtain a signal current in the form of a direct current; a high-pass filter connected to the other line to remove a low-frequency component in the signal current having passed through the low-pass filter; a second circuit connected to the second line to rectify the signal current having passed through the high-pass filter and thereby obtain a signal current in the form of a direct current; an arithmetic unit connected to the output sides of the two branch lines to arithmetically determine a relation of the signal current in a specific frequency band to the signal current in the entire frequency band; and a combustion controller connected to the output side of the arithmetic unit to effect combustion control on the basis of the output from the arithmetic unit.

BRIEF DESCRIPTION OF THE DRAWINGS

FIGS. 1 to 24 show embodiments of the present invention, in which:

FIG. 1 is a circuit diagram showing a first embodiment of the present invention;

FIG. 2 is a flowchart showing the processing operation of the ionic current oscillation controller;

FIGS. 3 and 4 are side views showing the positional relationship between a burner and electrodes;

FIG. 5 is a graph showing the change of the ionic current with time;

FIG. 6 is a graph showing the relationship between the power spectrum and the frequency;

FIGS. 7 to 13 are graphs showing various methods for signal conversion of the change in level of a high-frequency power spectrum component which changes in accordance with a change of the air-fuel ratio;

FIG. 14 is a graph showing the relationship between the content of $O_2$ in exhaust gas and the power spectrum;

FIG. 15 is a graph showing the relationship between the frequency and the power spectrum;

FIG. 16 is a sectional view showing an example in which the first embodiment is applied to an air heater in place of an industrial furnace;

FIG. 17 is a circuit diagram showing a second embodiment of the present invention;

FIG. 18 is a waveform chart showing light power signals input to the photosensor shown in FIG. 17;

FIG. 19 is a waveform chart showing the power spectra of the light power signals shown in FIG. 18;

FIG. 20 is a flowchart showing the operation of the circuit shown in FIG. 17;

FIG. 21 is a waveform chart showing power spectra obtained in the second embodiment;

FIG. 22 is a characteristic chart showing the relationship between the power spectrum integral ratio and the excess air ratio in the second embodiment;

FIG. 23 is a circuit diagram showing a third embodiment of the present invention; and FIG. 24 is a circuit diagram showing one modification of the embodiment shown in FIG. 23.

FIGS. 25 to 28 show prior arts, in which:

FIG. 25 is a circuit diagram showing a prior art related to the present invention;

FIG. 26 is a sectional view showing one example of a furnace;

FIG. 27 is a waveform chart showing power spectra; and

FIG. 28 is a graph showing the relationship between the power spectrum integral ratio and the excess air ratio.

EXPLANATION OF THE PREFERRED EMBODIMENTS

Figure 1:
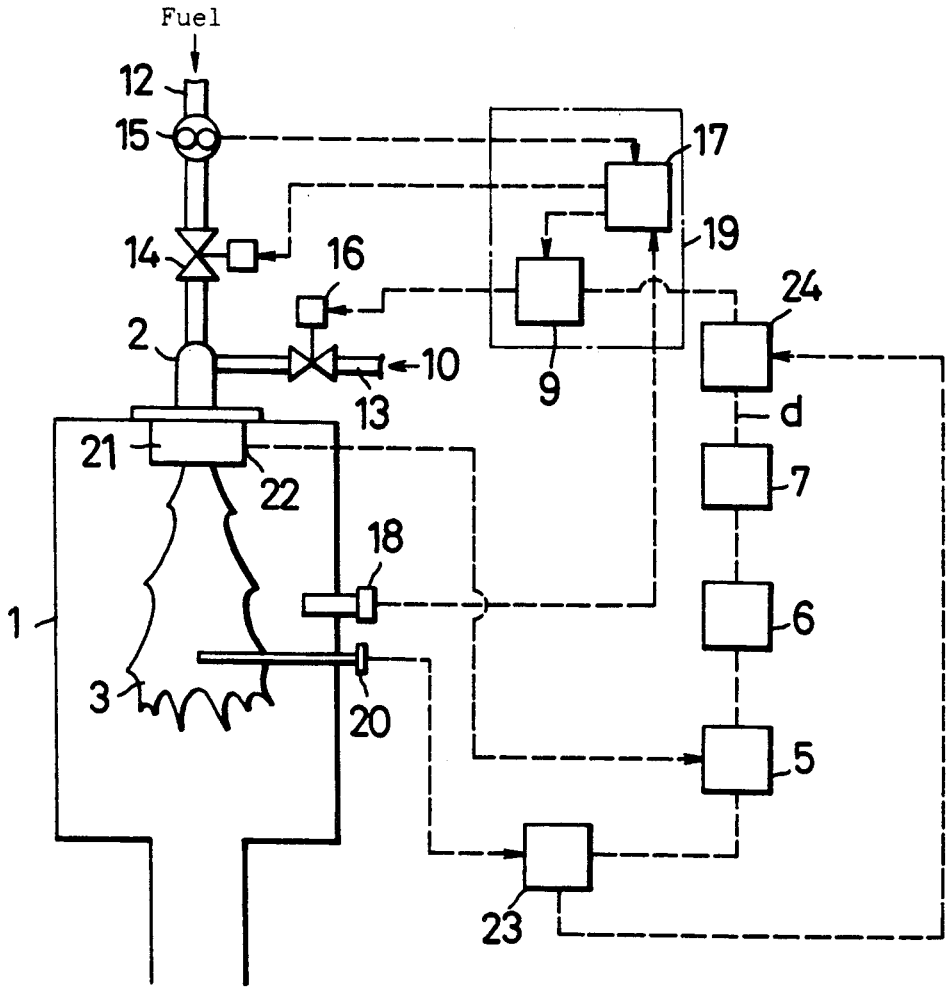

FIGS. 1 to 16 show in combination a first embodiment of the present invention. Referring to FIG. 1, the reference numeral 1 denotes a furnace for heat-treating a metallic product, for example. The furnace 1 is provided with a burner 2 which generates a flame 3.

The burner 2 is connected with a fuel supply pipe 12 and a combustion air supply pipe 13. The fuel supply pipe 12 is provided with a flow control valve 14 and a flowmeter 15, and the combustion air supply pipe 13 is provided with a flow control valve 16. The degree of opening of the fuel flow control valve 14 is controlled by a temperature controller 17.

More specifically, a thermometer 18 is installed on the furnace 1, and the temperature controller 17 is supplied with a signal from the thermometer 18 and a signal from the flowmeter 15 to compute and output a combustion rate (i.e., fuel flow rate) required to obtain a set temperature from the difference between the temperature inside the furnace 1 and the set temperature. The output from the temperature controller 17 is applied to both the fuel flow control valve 14 and the combustion air flow control valve 16. Thus, if the temperature inside the furnace 1 deviates from the set temperature, the fuel and combustion air flow rates are controlled so that the temperature inside the furnace 1 returns to the set temperature.

The flow rate of combustion air with respect to the flow rate of fuel is computed on the basis of the fuel flow rate by the temperature controller 17, but it is not preferable that the combustion air flow rate thus computed is applied directly to the combustion air flow controller 16. For instance, when air enters the furnace 1 through the door (not shown) of the furnace 1 that is opened, if the flow controller 16 is controlled directly by the output of the temperature controller 17 that is computed on the basis of the fuel flow rate, the heat loss by exhaust gas increases. When the atomized condition of fuel deteriorates due to an abnormally occurring in the burner 2, if the flow controller 16 is controlled directly by the output of the temperature controller 17 that is computed on the basis of the fuel flow rate, a large amount of soot is generated due to defective combustion. To eliminate such problems, the output from the temperature controller 17 is output to the flow control valve 16 after being compensated for in a combustion air flow compensator 9.

The combustion air flow compensator 9, together with the temperature controller 17, constitutes a flow control section 19 for combustion air. The output for compensation that is applied to the combustion air flow compensator 9 is produced in the combustion control apparatus according to the present invention described below.

The combustion control apparatus has an electrode 20 provided at a position where it faces the flame 3 produced by the burner 2 of the furnace 1, and a terminal 22 is provided on the flame radiating portion 21 of the burner 2.

The electrode 20 is connected to the input side of an ionic current interrupter 23. The output side of the ionic current interrupter 23 is connected to the input side of a detector 5. The terminal 22 is also connected to the detector 5. Thus, the detector 5 detects an ionic current in the flame 3. The ionic current interrupter 23 periodically cuts off the ionic current signal.

The output side of the detector 5 is connected to a frequency analyzer 7 comprising, for example, an FFT analyzer, through an amplifier which amplifies the detected ionic current signal, thereby affecting frequency analysis of the ionic current signal. An ionic current oscillation controller 24 is connected to the output side of the frequency analyzer 7.

The ionic current oscillation controller 24 detects a combustion condition on the basis of a power spectrum signal d output from the frequency analyzer 7 and an output signal from the ionic current interrupter 23, compares the detected combustion condition with an optimal combustion condition stored therein in advance to obtain an air flow compensation coefficient from a deviation of the detected combustion condition from the optimal one, and outputs the compensation coefficient signal to the flow control section 19. In response to the signal, the flow control section 19 delivers to the flow control valve 16 an output for obtaining the combustion air flow rate required to eliminate the deviation.

The signal that is output to the ionic current oscillation controller 24 from the ionic current interrupter 23 will next be explained. The ionic current interrupter 23, which periodically cuts off the signal from the electrode 20 as described above, is used to detect the effect of noise on the system by the interruption.

More specifically, when cutting off the signal from the electrode 20, the ionic current interrupter 23 informs the ionic current oscillation controller 24 that the signal is being cut off. The ionic current oscillation controller 24 judges the power spectrum signal d obtained during the interruption to be a noise and subtracts the noise component from the power spectrum signal d obtained with the signal from the electrode 20 is not cut off, thereby eliminating the effect of the noise. For this purpose, the ionic current interrupter 23 informs the ionic current oscillation controller 24 whether or not the signal from the electrode 20 is being cut off.

Figure 3:
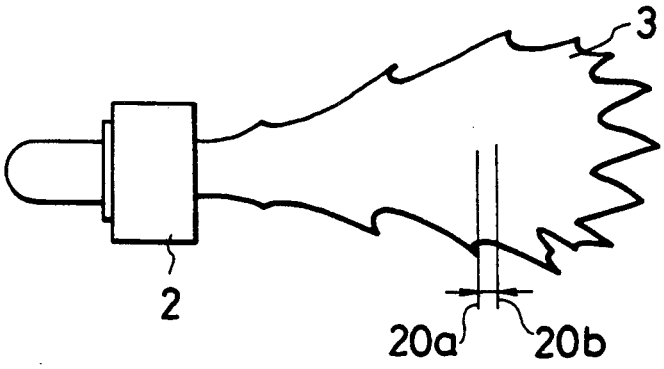
Figure 4:
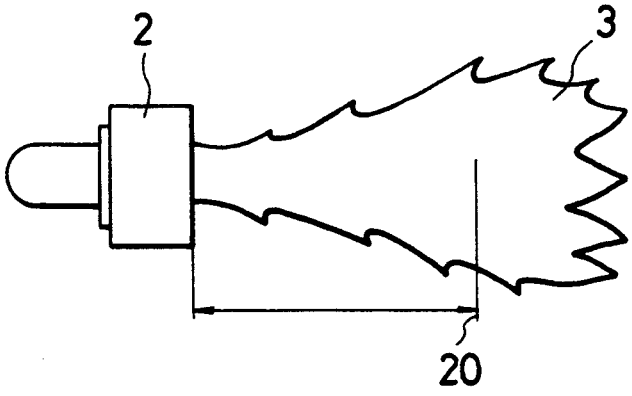

The operation of this embodiment will next be explained. This embodiment utilizes the fact that, when a liquid or gas fuel is burned in a combuster, the oscillation frequency of the ionic current in the burning flame 3 changes in accordance with a change of the combustion condition, as described above. A change of the ionic current in the burning flame 3 may be detected by detecting the level of the ionic current. In the present invention, however, it is detected as follows: Two electrodes 20*a* and 20*b* are provided in parallel so as to extend into the tip portion of the flame 3 to measure an ionic current flowing therebetween, as shown in FIG. 3, or a single electrode 20 is provided so as to extend into the flame 3 and an ionic current generated between the electrode 20 and the terminal 22 provided on the flame radiating portion 21 of the burner 2 is detected, as shown in FIG. 4 (see FIG. 1 for the latter method).

Figure 5:
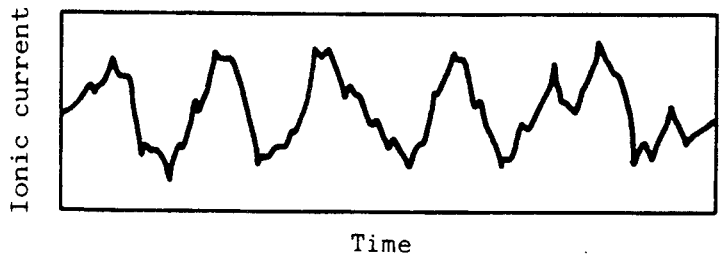
Figure 6:
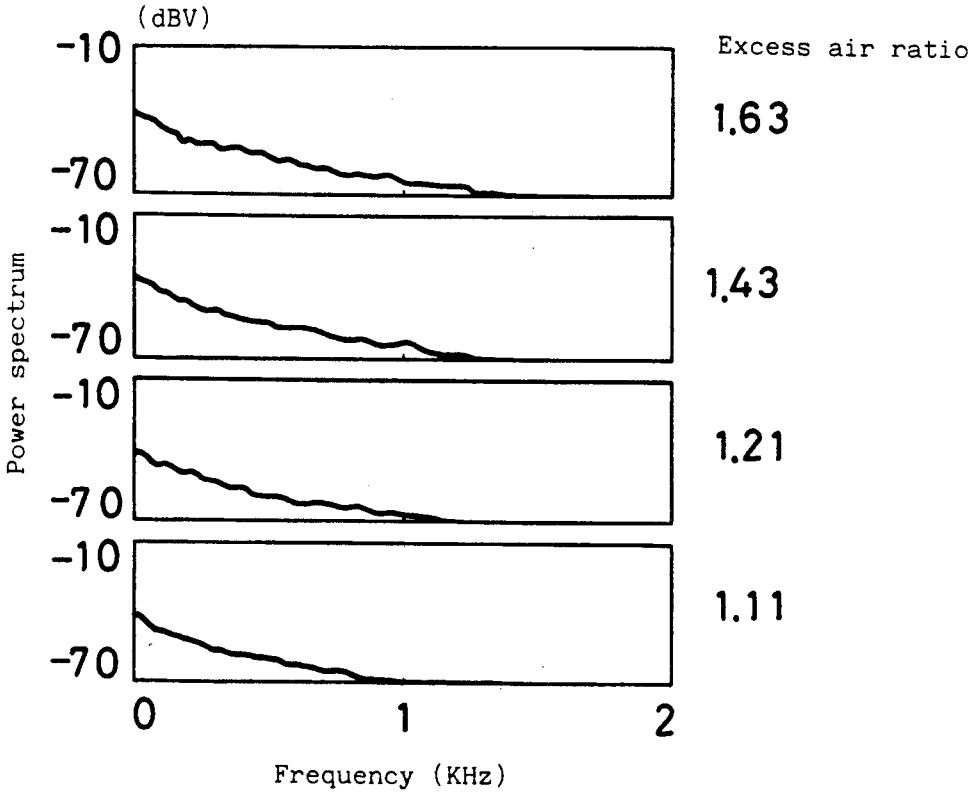

The ionic current signal that is obtained by either of the above-described methods is an oscillating current such as that shown in FIG. 5. This signal is input to the frequency analyzer 7 to obtain a power spectrum such as that shown in FIG. 6. As the air-fuel ratio, which is one index indicating the combustion condition, is changed, the level of the higher-frequency component of the power spectrum changes, as shown in FIG. 6. There are several different kinds of method, such as those shown in FIGS. 7 to 13, which are usable to convert the level change into a control signal.

Figure 7:
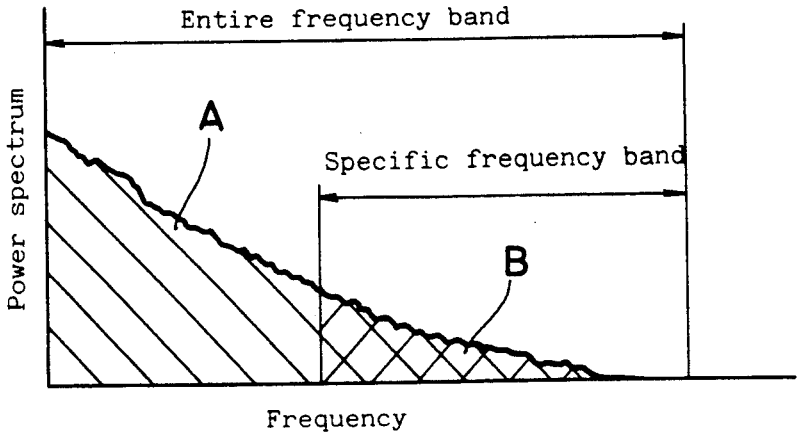
Figure 8:
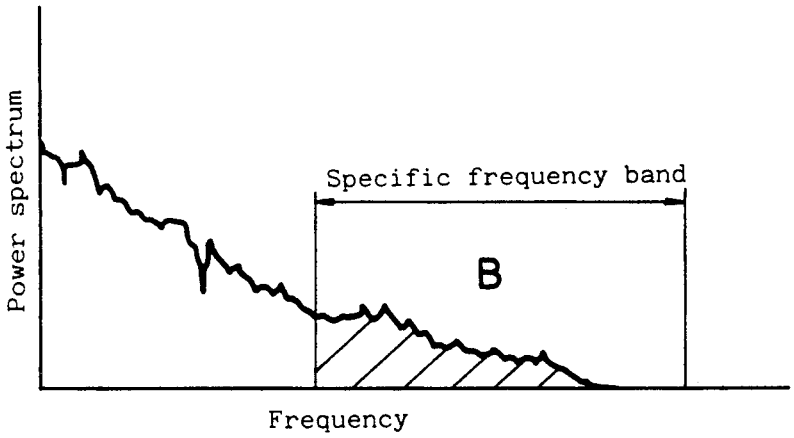
Figure 9:
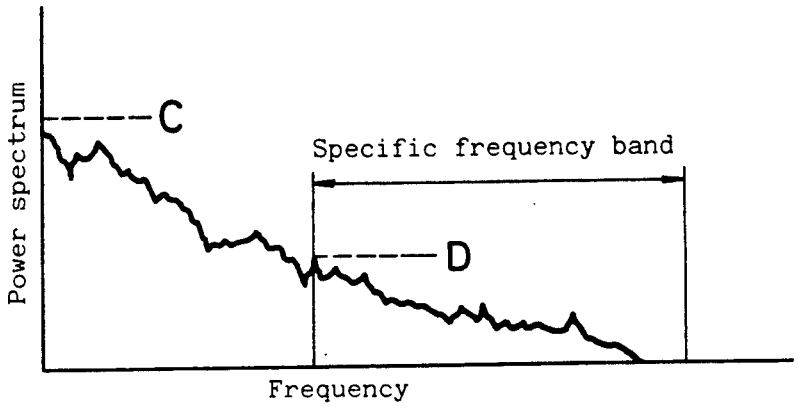

FIG. 7 shows a method that uses the ratio B/A of the integral value B of the power spectrum in a specific frequency band where the power spectrum greatly changes in accordance with a change in the combustion condition to the integral value A of the power spectrum in the entire frequency band. FIG. 8 shows a method wherein the integral value B in the specific frequency band is used as it is. FIG. 9 shows a method that uses the ratio D/C of the maximum value D in the specific frequency band to the maximum value C in the entire frequency band.

Figure 10:
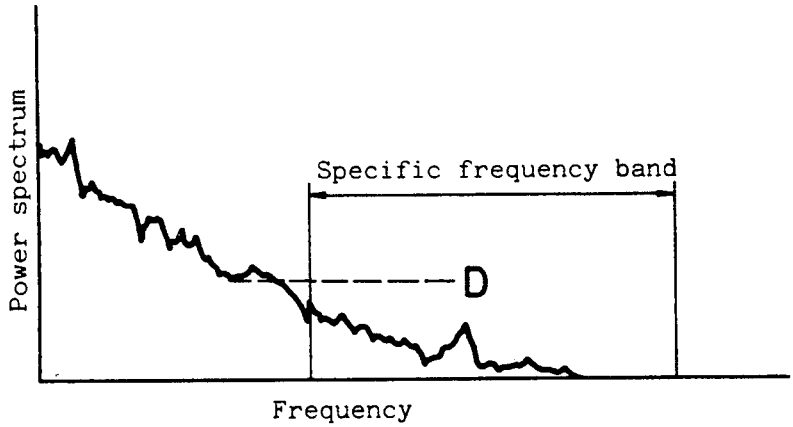
Figure 11:
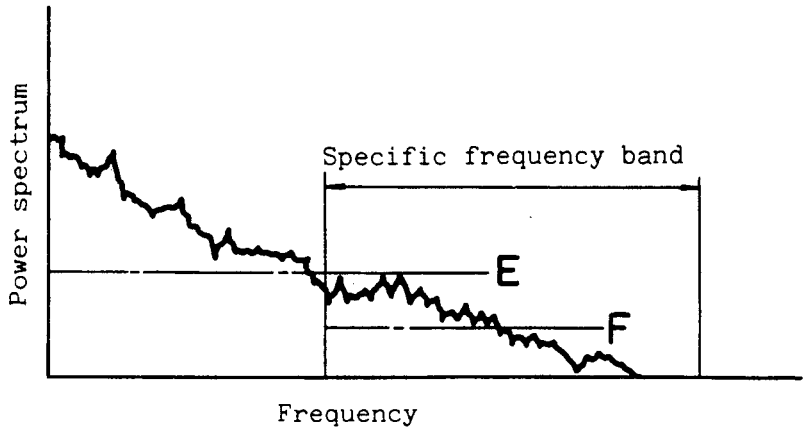
Figure 12:
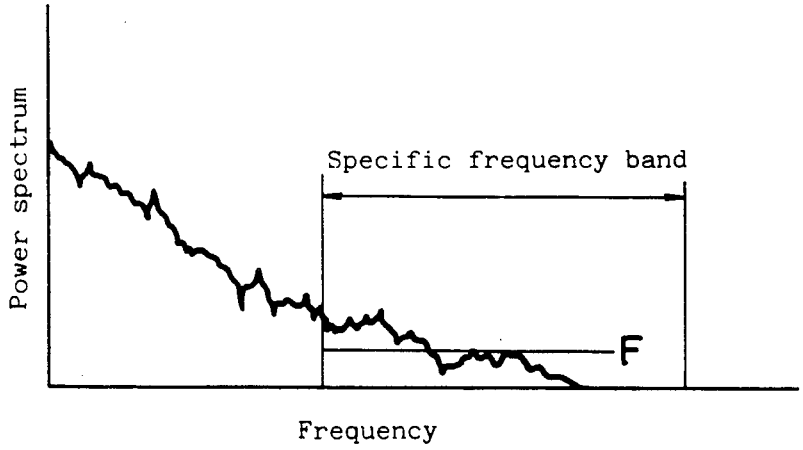
Figure 13:
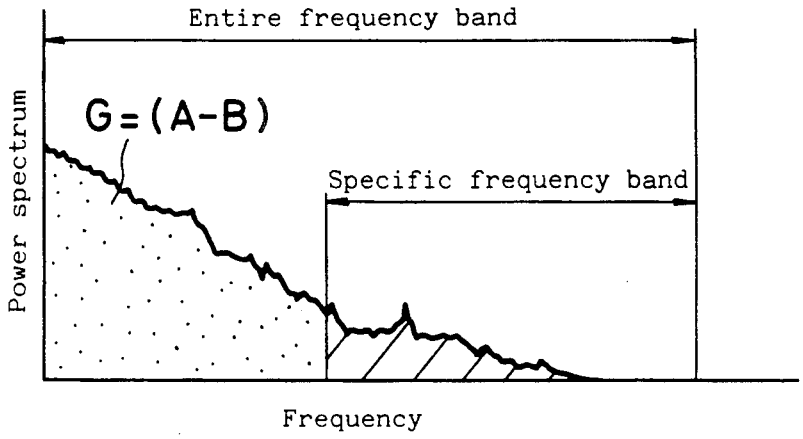

FIG. 10 shows a method in which the maximum value D in the specific frequency band is used as it is. FIG. 11 shows a method that uses the ratio F/E of the mean value F in the specific frequency band to the mean value E in the main frequency band. FIG. 12 shows a method in which the mean value F in the specific frequency band is used as it is. FIG. 13 shows a method that uses that ratio B/(A-B) of the integral value B in the specific frequency band to the value obtained by subtracting the integral value B from the integral value A in the entire frequency band.

Figure 14:
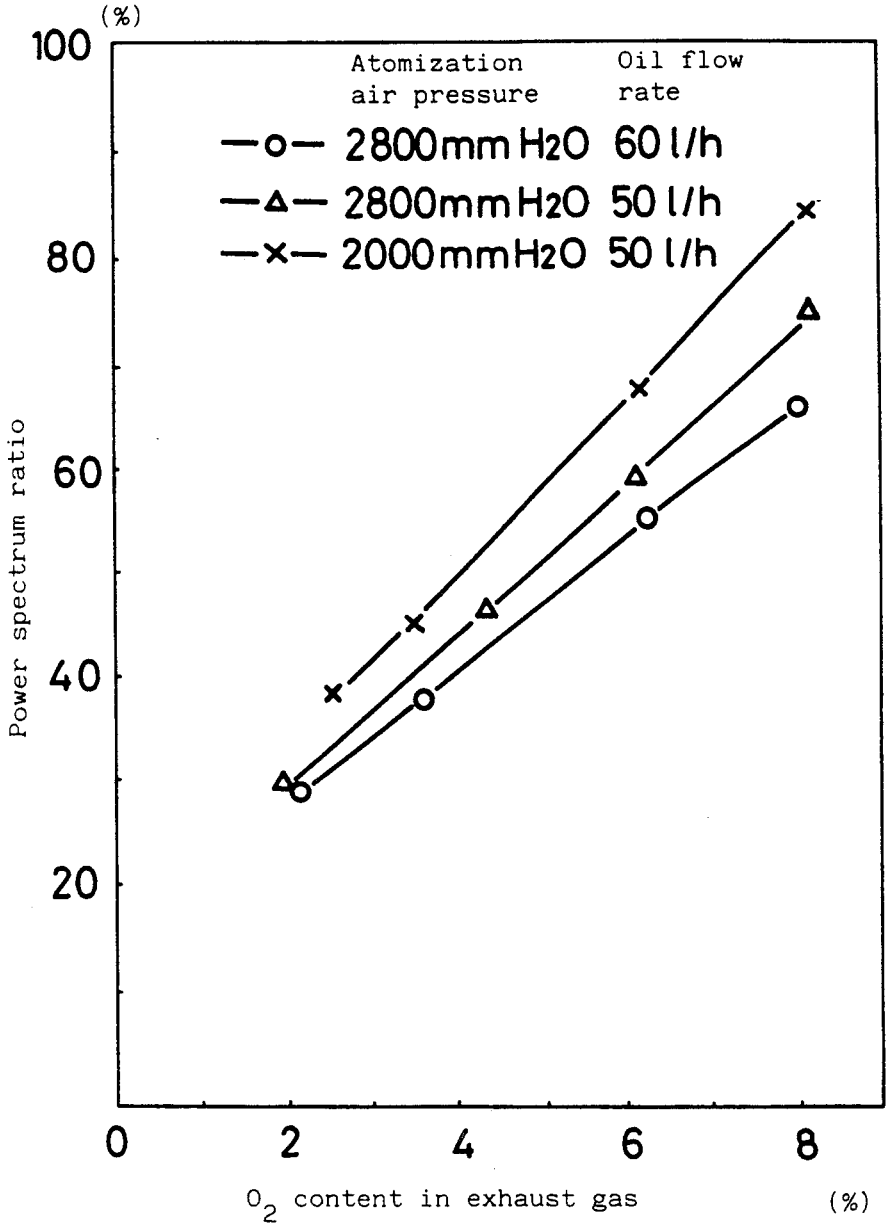
Figure 15:
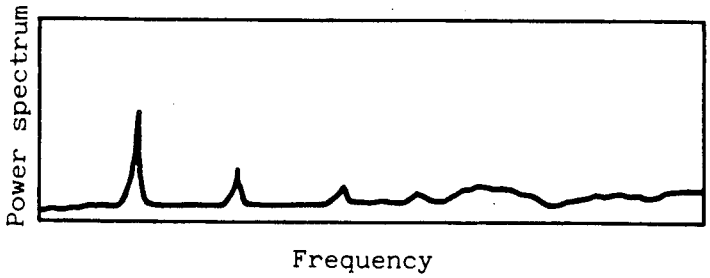

Any of these methods may be employed. FIG. 14 shows the change of the value that is obtained by the method shown in FIG. 13. As will be clear from the figure, the value obtained by the method shown in FIG. 13 changes in proportion to the change of the $O_2$ content (%) in exhaust gas, which is one index indicating the combustion condition.

Accordingly, it is possible to control the combustion condition by use of the value obtained by the method showing in FIG. 13. Since measurement is carried out on the basis of the oscillation frequency of the ionic current caused by combustion, the output of the ionic current oscillation controller 24 is zero when there is no flame 3. Therefore, the ionic current oscillation controller 24 may also be used as a means for detecting whether or not there is a flame 3 from the decrease of the output thereof.

Figure 2:
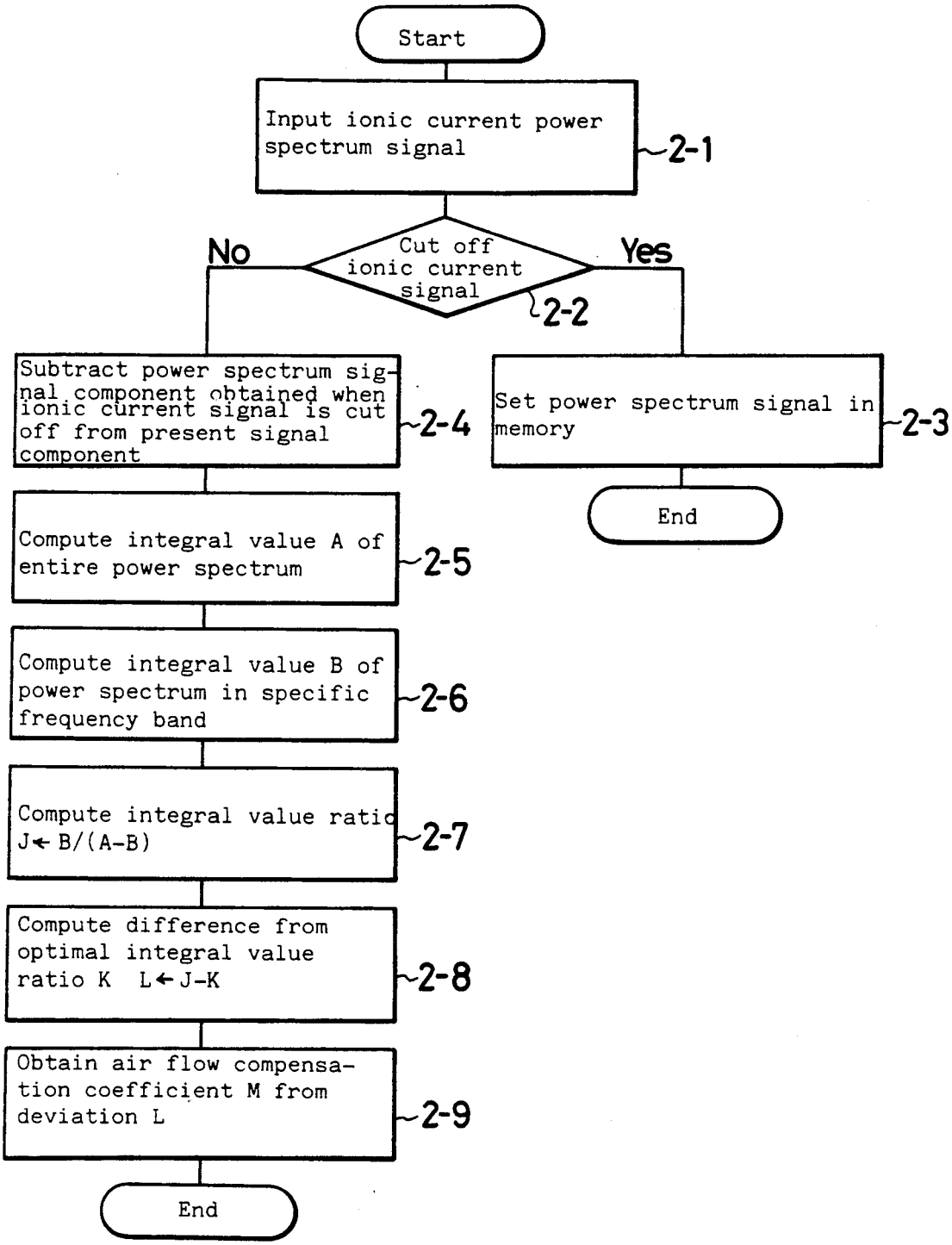

The steps of processing carried out in the ionic current oscillation controller 24 will next be explained with reference to FIG. 2. First, the power spectrum signal is input in Step 2-1, and it is judged in Step 2-2 whether or not the ionic current signal line is being cut off on the basis of the signal from the ionic current interrupter 23. If YES, the process proceeds to Step 2-3, in which a signal which is obtained from a noise entering from the outside of the apparatus, such as that shown in FIG. 15, and a noise generated inside the apparatus, is stored in the associated memory.

If it is judged in Step 2-2 that the ionic current signal line is not being cut off, the process proceeds to Step 2-4, in which the power spectrum component stored in the memory in Step 2-3 is subtracted from the present power spectrum signal obtained from the signal which is, in turn, obtained from the flame 3 to obtain a true power spectrum signal representative of the combustion condition of the flame 3.

Then, an integral value A of the power spectrum signal in the entire frequency band is computed in Step 2-5 and an integral value B in a specific frequency band is computed in Step 2-6, as shown in FIG. 13. The specific frequency band is a frequency band where the power spectrum changes most in accordance with a change of the combustion condition. Next, an integral value ratio J←B/(A-B) is obtained in Step 2-7. On the other hand, an integral value ratio (power spectrum ratio) K corresponding to an optimal combustion condition has previously been obtained for each various fuel flow rates and set in the ionic current oscillation controller 24. Thus, a difference L←J-K between the present integral value ratio J and the optimal integral value ratio K is obtained in Step 2-8, and a combustion air flow compensation coefficient M is computed on the basis of the deviation L in Step 2-9.

The combustion air flow compensation coefficient M obtained in this way is output from the ionic current oscillation controller 24 to the combustion air flow compensator 9. The compensator 9 receives a reference air flow signal N from the temperature controller 17 in addition to the combustion air flow compensation coefficient M. The reference air flow signal N is computed in the temperature controller 17 on the basis of the fuel flow signal. Thus, the combustion air flow compensator 9 carries out computation for compensation on the basis of the input signals M and N and outputs the result of the comparison to the flow control value 16 to control the degree of opening thereof.

Figure 16:
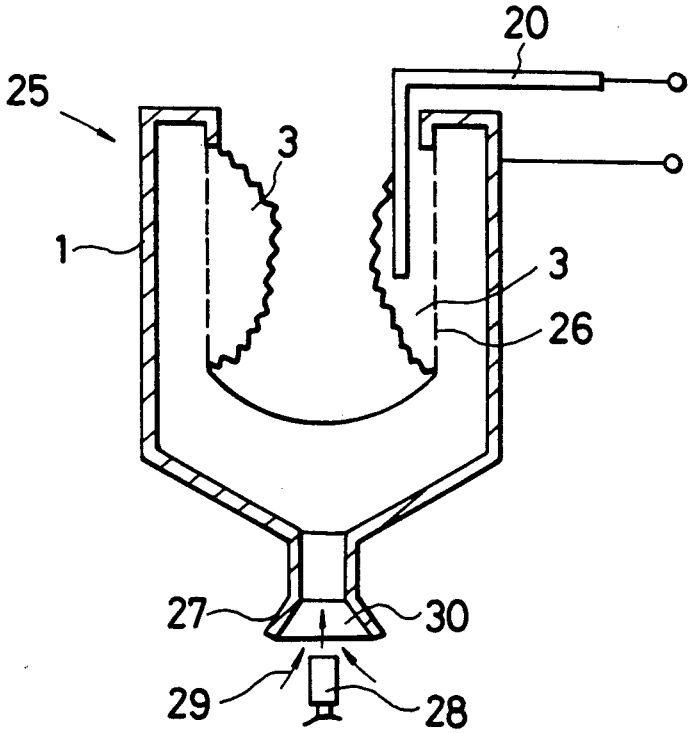

Although in the foregoing embodiment the present invention is applied to an industrial furnace, it should be noted that the present invention may also be applied to any kind of combustor, for example, a boiler, gas water heater, oil/gas air heater, combustor for gas turbine, etc. FIG. 16 shows an air heater 25, which is one example of other application of the present invention. The air heater 25 utilizes the ionic current generated between an electrode 20 inserted into a flame 3 produced inside the furnace 1 and the furnace 1 itself. The reference numeral 26 denotes a combustion plate, 27 an air nozzle, 28 a gas nozzle, 29 air, and 30 gas.

A second embodiment of the present invention will next be explained with reference to FIGS. 17 to 22.

Figure 17:
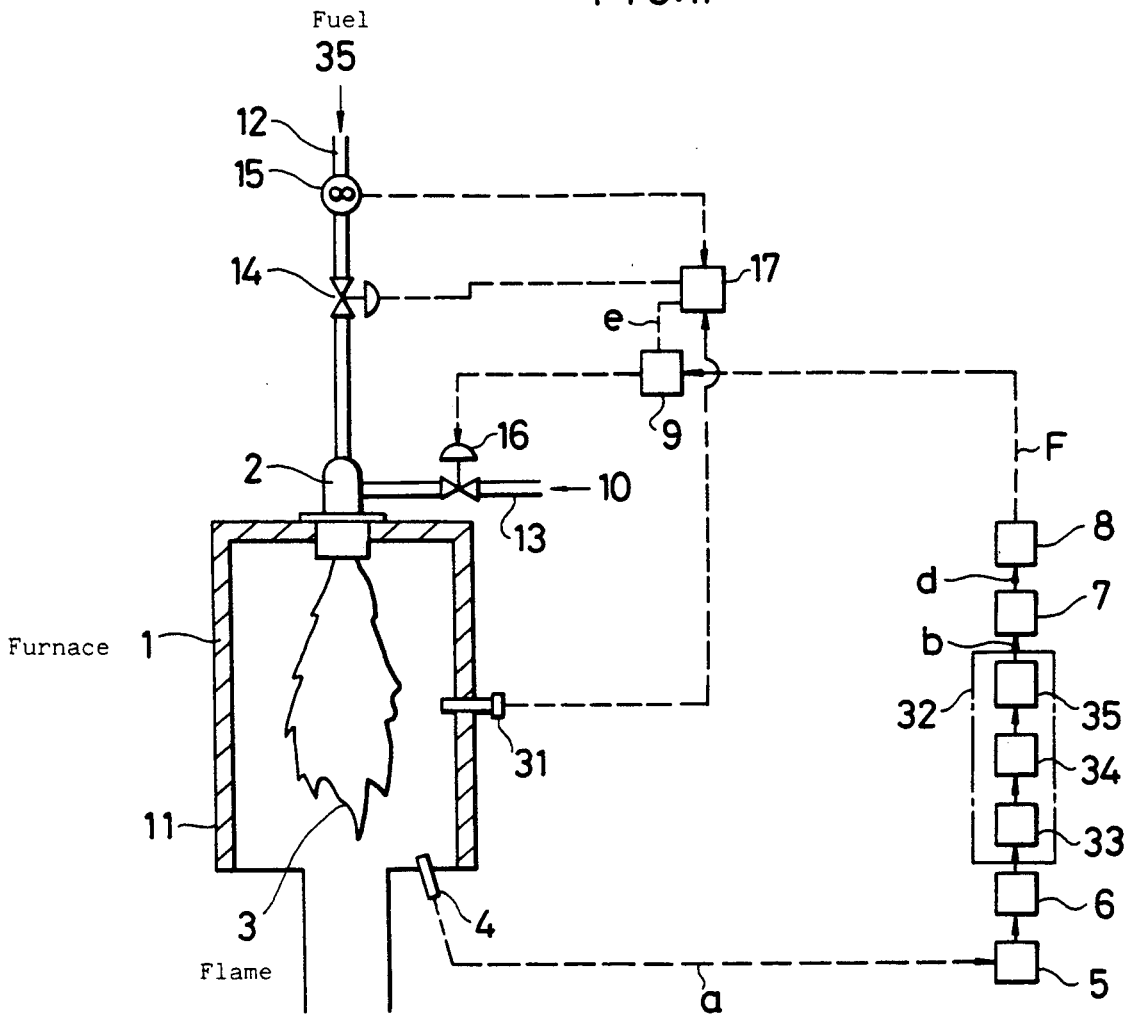
Figure 18:
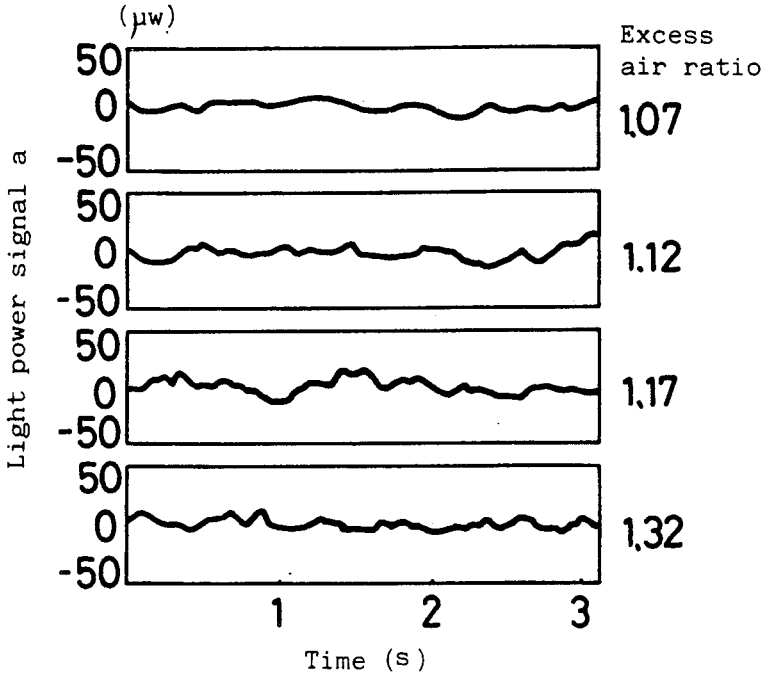

Referring to FIG. 17, a burner 2 is connected with a fuel supply pipe 12 for supplying fuel and an air supply pipe 13 for supplying air. The fuel supply piper 12 is provided with a flow control valve 14 and a flowmeter 15, and the air supply pipe 13 is provided with a flow control valve 16. The flow control valve 14 and the flowmeter 15 are connected to a temperature controller 17, while the flow control valve 16 is connected to an air flow compensator 9 which is one example of the air flow control means.

The furnace 1 is provided with a temperature sensor 31. The temperature sensor 31 is connected to the temperature controller 17. Thus, the temperature controller 17 controls the flow control valve 14 on the basis of the temperature detecting signal from the temperature sensor 31. The temperature controller 17 further generates a temperature compensation signal e on the basis of the signal from the flowmeter 15 and outputs the signal e to the air flow compensator 9. The amplifier 6 has a low-pass filter 32 connected thereto. The low-pass filter 32 comprises an analog filter 33, and A/D converter 34 and a digital filter 35 which are connected in series.

The analog filter 33 has a change-over switch (not shown) for changing over pass frequency bands from one to another and is therefore capable of setting a desired one of the pass frequency bands over several ranges by means of the change-over switch. Thus, by setting a particular pass frequency band, it is possible to cut off the component in the light power signal a amplified in the amplifier 6 that exceeds the set pass frequency band, that is, the component above a specific frequency.

The A/D converter 34 A/D converts the light power signal a having passed through the analog filter 33. The digital filter 35 is capable of setting a particular pass frequency band in the same way as in the analog filter 33. Thus, the digital filter 35 cuts off the component in the digital light power signal a that is above a specific frequency to obtain a light power signal b consisting of the low-frequency component and outputs it to the frequency analyzer 7. In this case, the analog filter 33 and the digital filter 35 are used in combination in accordance with the characteristics of the light power signal a to be processed. Thus, a particular pass frequency band is set by combination of the two filters so that the excess air ratio and the power spectrum integral ratio are in optimal relation to each other.

The frequency analyzer 7 frequency-analyzes the low-frequency light power signal b to generate a power spectrum and outputs it to a light power oscillation controller 8 which is connected thereto. The light power oscillation controller 8 has previously been stored with a reference frequency (lower than the specific frequency) and an optimal integral ratio D. Thus, the frequency analyzer 7 arithmetically processes the power spectrum input thereto on the basis of the stored data in the manner shown in FIG. 20 to compute an air flow compensation coefficient.

Figure 20:
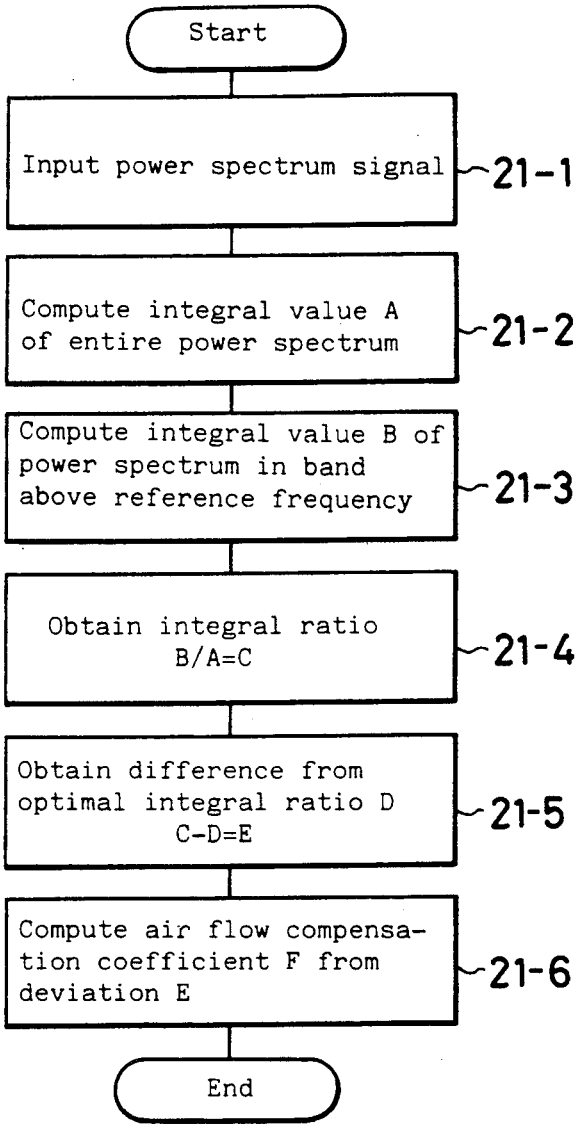
Figure 21:
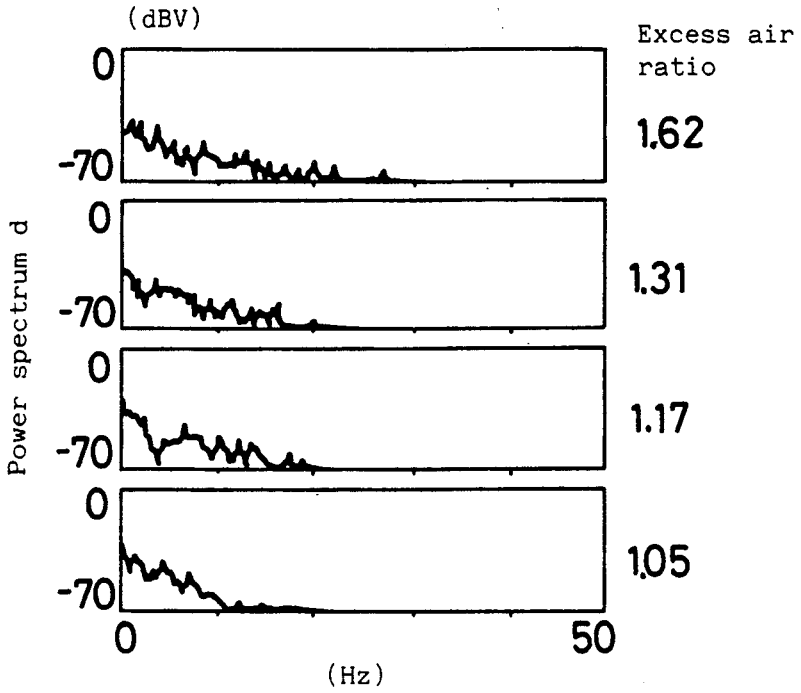

FIG. 20 shows the flow of the process executed by the frequency analyzer 7. More specifically, when the power spectrum d is input (Step 21-1), an integral value A of the power spectrum d in the entire frequency band is computed (Step 21-2), and an integral value B in the band above the reference frequency is computed (Step 21-3). Next, the ratio of the integral value B to the integral value A is determined to obtain a power spectrum integral ratio C (Step 21-4). Subsequently, the integral ratio C is compared with the preset optimal integral ratio D to obtain a deviation E (Step 21-5). Next, an air flow compensation coefficient F is computed as being relational data on the basis of the deviation E (Step 21-6).

In this case, the reference frequency has previously been set in accordance with the characteristics of the furnace 1 and the burner 2 so that the rate of change of the power spectrum integral ratio C with respect to a change of the excess air ratio is maximized. The light power oscillation controller 8 outputs the thus computer air flow compensation coefficient F to an air flow compensator 9 which is one example of the air flow control means. The air flow compensator 9 compensates for the temperature compensation signal e on the basis of the air flow compensation coefficient F and controls the flow control valve 16 on the basis of the result of the compensation, thereby controlling the flow rate of the air 10 supplied to the burner 2.

The following is a description of the operation of the combustion control apparatus arranged as described above. First, a light power signal a is detected by the photosensor 4 (see FIG. 18). The light power signal a is amplified in the amplifier 6 and then input to the analog filter 33 where the light power signal component above the specific frequency is cut off. The data output from the analog filter 33 is converted into a digital signal, which is then input to the digital filter 35 where the signal component above the specific frequency is cut off again, thereby obtaining a low-frequency light power signal b.

The low-frequency light power signal b is input to the frequency analyzer 7 to obtain a power spectrum d (see FIG. 19), which is then sent to the light power oscillation controller 8. When fed with the power spectrum d, the light power oscillation controller 8 executes the above-described arithmetic processing shown in FIG. 20 to obtain and output an air flow compensation coefficient F to the air flow compensator 9.

Figure 19:
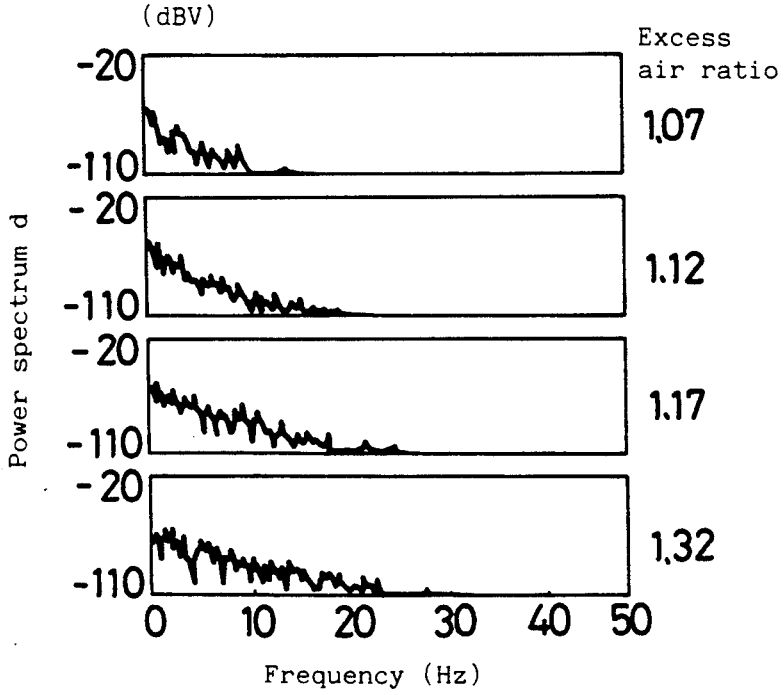
Figure 22:
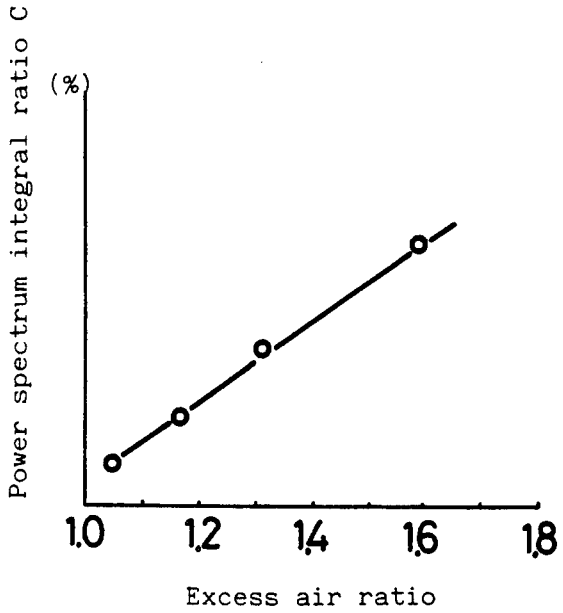

In this case, since the light power signal component above the specific frequency has already been cut off in the analog and digital filters 33 and 35, the power spectrum d output from the frequency analyzer 7 has the high-frequency component already removed therefrom, as exemplarily shown in FIG. 19, so that the rate of change of the power spectrum integral ratio C, obtained in Step 21-4, with respect to the excess air ratio increases, as exemplarily shown in FIG. 22. As a result, it becomes possible to surely determined an excess air ratio if the power spectrum integral ratio C is determined.

The air flow compensator 9 is supplied with the air flow compensation coefficient F obtained on the basis of the power spectrum integral ratio C that can surely determined the excess air ratio, and controls the flow control valve 16 in this state. Thus, the flow rate of the air 10 supplied to the burner 2 is controlled so as to obtain an excellent combustion condition. It should be noted that the reference frequency may be set so as to indicate the rate of change required depending upon the control contents, although not explained in this embodiment.

Figure 25:
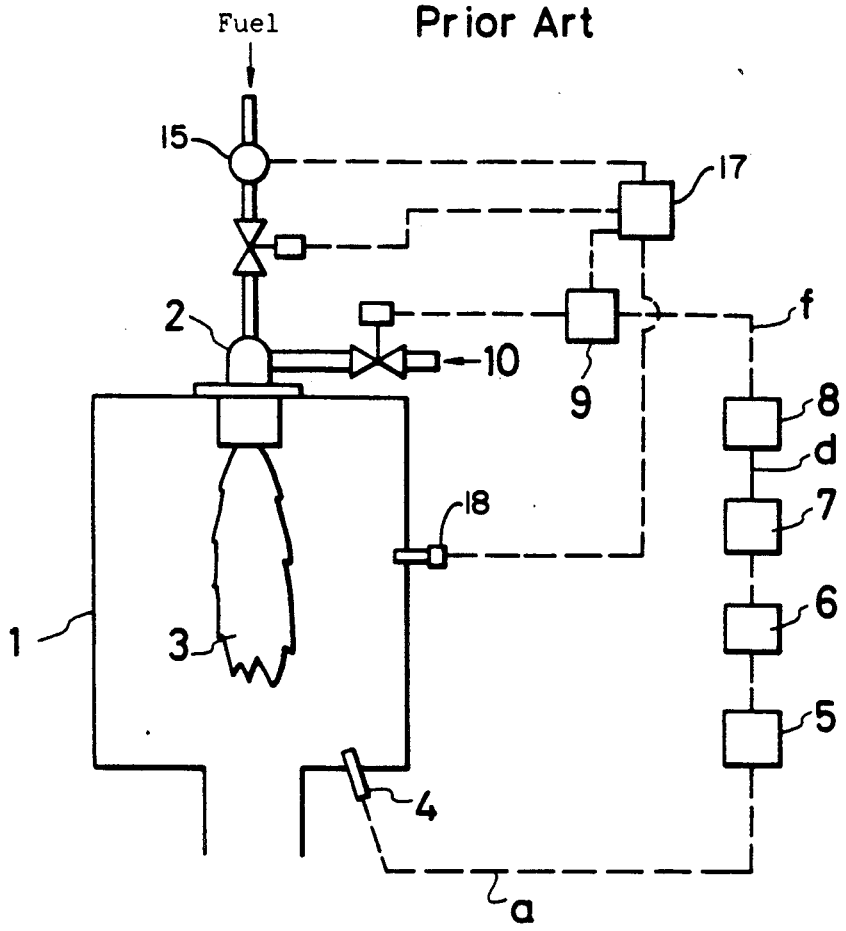
FIG.25 Prior Art
Figure 26:
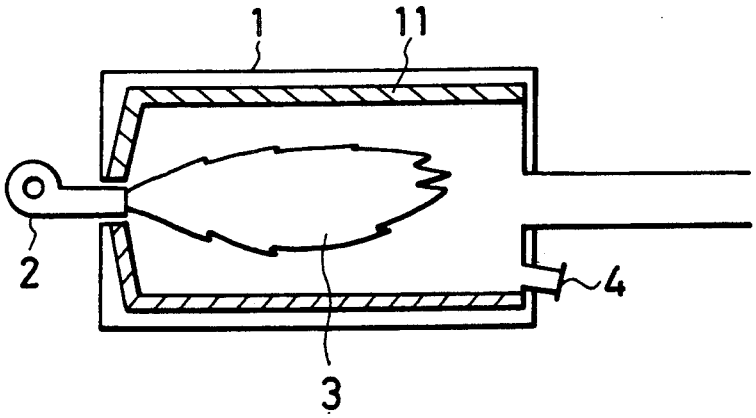
FIG.26 Prior Art
Figure 27:
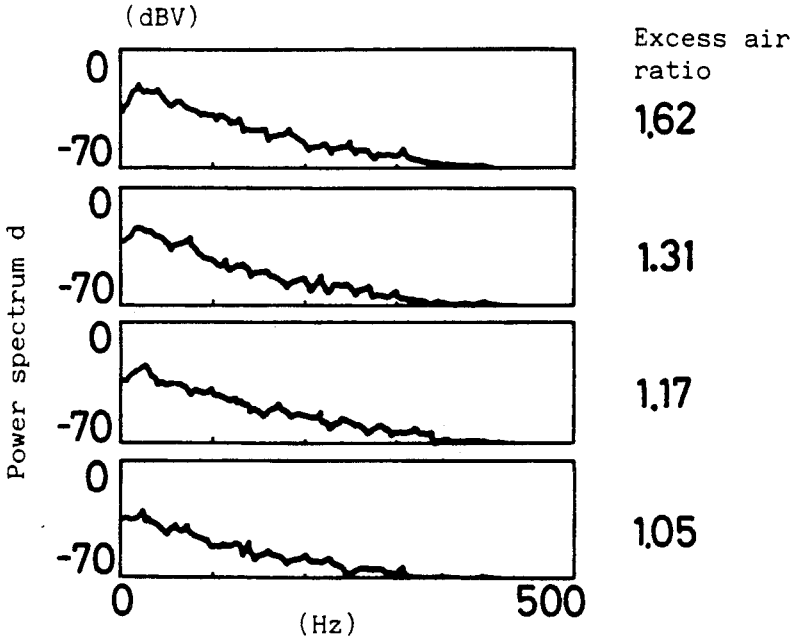
FIG.27 Prior Art
Figure 28:
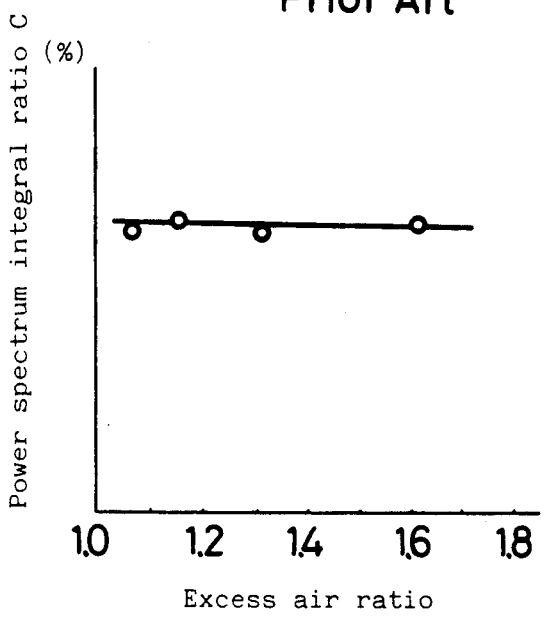
FIG.28 Prior Art

Although in this embodiment the analog and digital filters 33 and 35 are employed to constitute the low-pass filter 32, either one of the filters 33 and 35 alone may be employed to constitute the low-pass filter 32. By doing so, the apparatus can be simplified. In this connection, an apparatus arranged by employing the analog filter 33 alone to constitute the low-pass filter 32 was applied to the combustor shown in FIG. 25 and an experiment was conducted with heavy oil A being supplied at a flow rate of 60 l/h and with various excess air ratios, i.e., 1.62, 1.31, 1.17 and 1.05. As a result, power spectra d and the rate of change of the power spectrum integral ratio C, such as those shown in FIGS. 21 and 22, were obtained. Thus, it was made clear that it is possible to increase the power spectrum integral ratio C and hence attain an excellent combustion condition.

Figure 23:
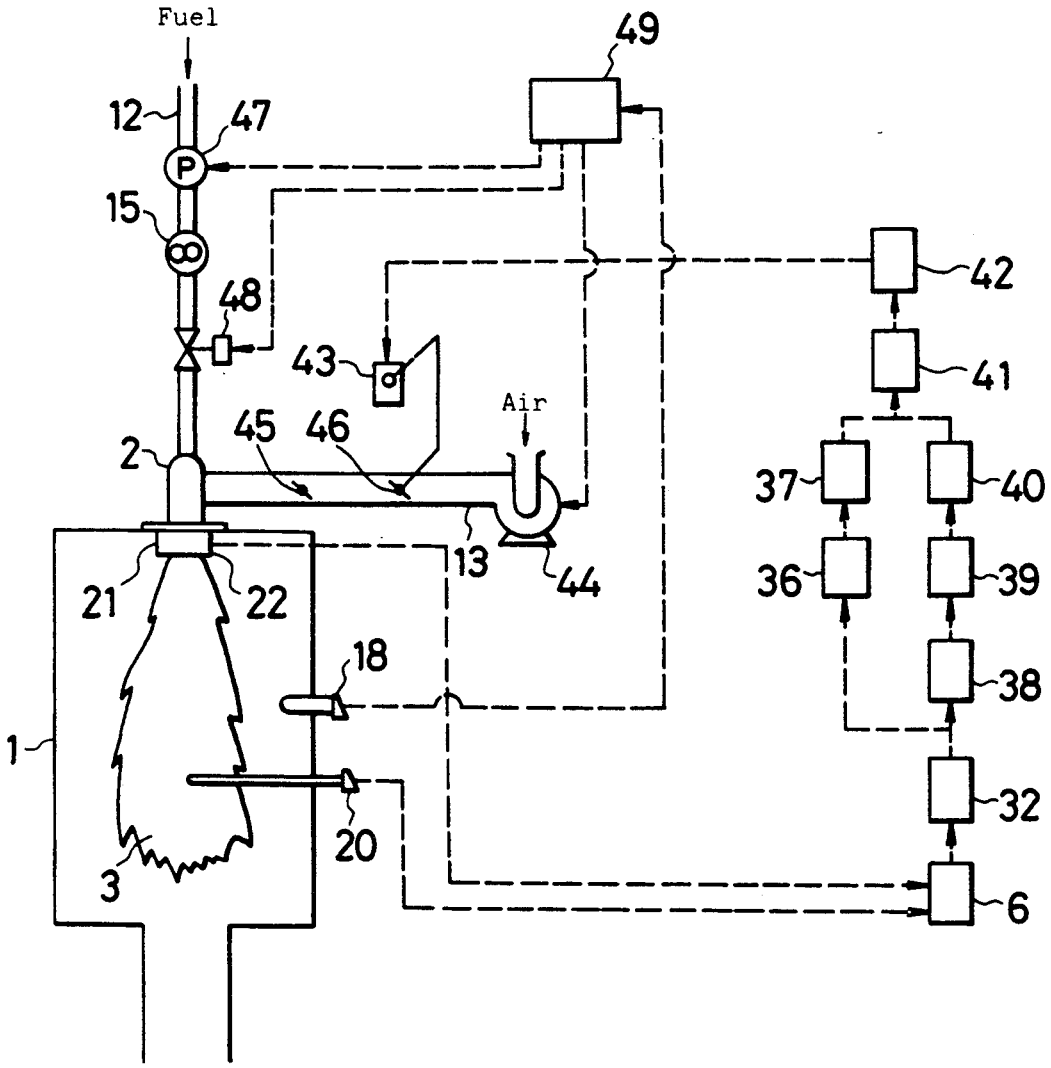

A third embodiment of the present invention will next be explained with reference to FIG. 23. The furnace 1 has an electrode 20 which is attached thereto so as to extend into the tip portion of the flame 3 generated from the burner 2, and a terminal 22 is provided on the flame radiating portion 21 of a burner 2 provided in the furnace 1. The electrode 20, together with the terminal 22, is connected to the input side of an amplifier 6 which amplifies an ionic current generated between the electrode 20 and the terminal 22. To the output side of the amplifier 6 is connected a low-pass filter 32 which removes the high-frequency component in the ionic current. The post-stage, that is, the output side, of the low-pass filter 32 branches out into two lines.

To one of the two branch lines are connected a rectifier 36 which rectifies the signal current having passed through the low-pass filter 32 and an integration circuit 37 which smooths the pulsating rectified current to obtain a signal current in the form of a direct current. To the other line are connected a high-pass filter 38 which removes the low-frequency component in the signal current having passed through the low-pass filter 32, a rectifier 39 which rectifies the signal current having passed through the high-pass filter 38, and an integration circuit 40 which smooths the pulsating rectified current to obtain a signal current in the form of a direct current.

These two lines join together at the output sides of the integration circuits 37 and 40 and are connected to the input side of an arithmetic unit 41 which arithmetically obtains the relation of the signal current in a specific frequency band to the signal current in the entire frequency band. To the output side of the arithmetic unit 41 is connected an air flow compensating controller 42 which functions as a combustion controller that receives the output signal from the arithmetic unit 41 to affect combustion control. The output side of the air flow compensating controller 42 is connected to a modutrol motor 43. To the burner 2 is connected a combustion air supply pipe 13 for feeding air by the operation of a combustion air feed fan 44. In the combustion air supply pipe 13 are provided a semi-fixed damper valve 45 and a compensating damper valve 46 which is driven to open and close by the modutrol motor 43.

A fuel injection pump 47 is connected to the intermediate portion of a fuel supply pipe 12 and at the upstream side of a flowmeter 15, and a fuel cut-off valve 48 is connected to the fuel supply pipe 12 at the downstream side of the flowmeter 15. The fuel injection pump 47, the fuel cut-off valve 48 and the combustion air feed fan 44 are connected to the output side of a master controller 49 which arithmetically processes a signal that is supplied thereto from a thermometer 18.

The following is a description of the operation of the burner combustion control apparatus arranged as described above. When the burner 2 in the furnace 1 is in a burning state, the thermometer 18 detects the temperature inside the furnace 1 and sends it to the master controller 49, and the electrode 20 detects an ionic current flowing between the same and the terminal 22 provided on the flame radiating portion 21 of the burner 2.

When the signal from the thermometer 18 is input to the master controller 49, the controller 49 compares the value represented by the signal with a set temperature range previously set therein. If the input reaches the upper limit of the set temperature range, the master controller 49 transmits a stop signal to the combustion air feed fan 44, the fuel injection pump 47 and the fuel cut-off valve 48 which are connected to the intermediate portion of the fuel supply pipe 12 to thereby suspend the operations of these elements. If the temperature detected by the thermometer 18 reaches the lower limit of the set temperature range, the master controller 49 transmits a start signal to the combustion air feed fan 44, the fuel injection pump 47 and the fuel cut-off valve 48, which have been in an inoperative state, to resume the operation.

The fuel control during operation in a fixed state wherein the amount of fuel supply is 100% is affected so that the air-fuel mixture is slightly air-rich on the safe side by means of the semi-fixed damper valve 45 provided in the combustion air supply pipe 13. After the control has been properly affected, the semi-fixed damper valve 45 is fixed. On the other hand, the ionic current flowing between the electrode 20 and the terminal 22 provided on the flame radiating portion 21 of the burner 2 is amplified in the amplifier 6 and then input to the low-pass filter 32 where the high-frequency component in the signal is removed. Thereafter, the signal is branched into the two lines.

In one of the two lines, the output signal from the low-pass filter 32 is rectified in the rectifier 36 and then smoothed in the integration circuit 37 to obtain a signal current in the form of a direct current (integral value A). The signal representative of the integral value A is input to the arithmetic unit 41.

In the other of the two lines, the low-frequency component in the signal is removed in the high-pass filter 38. Thereafter, the signal is rectified in the rectifier 39 and smoothed in the integration circuit 40 to obtain a signal in the form of a direct current (integral value B), which is then input to the arithmetic unit 41. In the arithmetic unit 41, B/(A-B) is computed, and the result of the operation is input to the air flow compensating controller 42.

In response to the input signal, the air flow compensating controller 42 generates a signal corresponding to an air flow compensating coefficient with which an optimal combustion control is affected, and sends the signal to the modutrol motor 43. In response to the input signal, the modutrol motor 43 controls the compensating damper valve 46 to affect an optimal combustion control. Although in this embodiment the compensating damper valve 46 is provided separately from the semi-fixed damper valve 45, either one of the two valves may be arranged so as to also serve as the other.

Since in this combustion control apparatus an ionic current caused by combustion is measured, if there is no flame 3, the output is zero. Therefore, the combustion control apparatus may function also as a means for detecting whether or not there is a flame 3. The following is a description of general initial air-fuel ratio control in an industrial furnace or the like where ON/OFF control of combustion is affected.

In ON/OFF control, the amount of fuel supply is also either 0 or 100%, as a matter of course. In general, the combustion air flow rate is controlled and fixed by a damper valve or the like in conformity with the 100%-fuel flow rate. In such a case, it is a general practice to set the combustion air flow rate so that the resulting air-fuel mixture is a little air-richer than in the case of an optimal air flow rate, with a view to ensuring safe combustion. When the combustor is operated throughout a year, since the air density in summer is different from that in winter because of the temperature difference, the air flow rate is generally set in conformity with the air density in summer when it decreases. In such a case also, the air flow rate is set so that the resulting air-fuel mixture is air-rich, thereby ensuring safe combustion.

Assuming that the temperature difference between summer and winter is 30 deg and the $0_2$ content in exhaust gas in summer is 5% and the volume of air in summer is 1, the air volume decreases to 0.9 in winter. For this reason, if the same damper opening is used both in summer and winter, the air-fuel mixture in winter becomes air-richer than in summer and the $O_2$ content in exhaust gas also becomes about 6.6% in winter, resulting in an increase in the heat loss by exhaust gas. In contrast, the combustion controller of the present invention enables these matters to be improved by a large margin.

Figure 24:
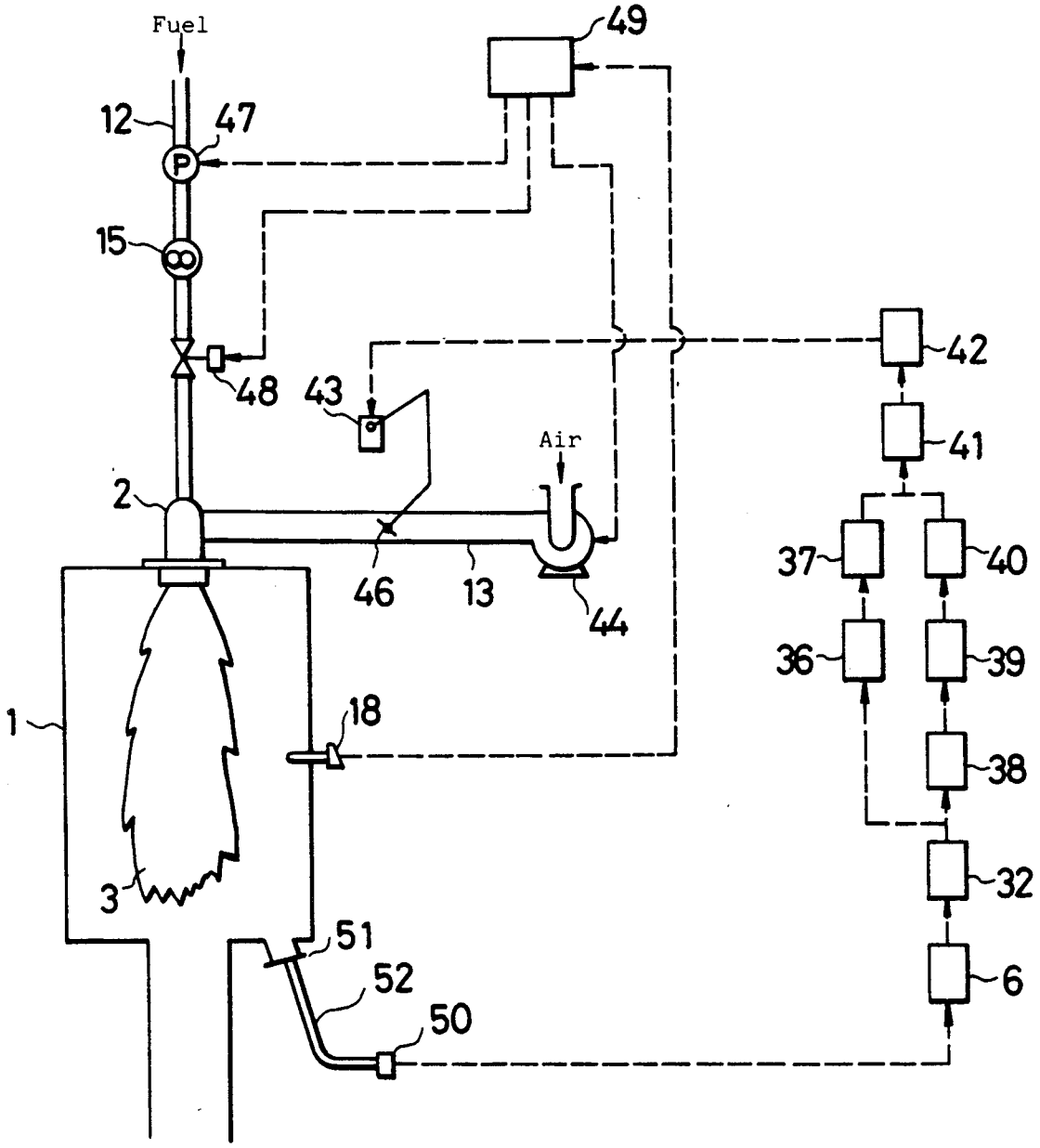

FIG. 24 shows one modification of the third embodiment, in which a photosensor is used in place of the ionic current detecting means as a means for detecting a combustion condition, to convert vibration of light in the flame 3 from the burner 2 into an electric signal. Since the contents of the signal processing system and the control system are the same as those in the third embodiment, the arrangement of the optical signal detecting section alone will be explained below. A photosensor 50 is provided at a position on the distal end portion of the furnace 1 which faces the flame 3 from the burner 2, that is, a position where the flame 3 can be monitored.

The photosensor 50 is attached not directly but indirectly to the furnace 1. More specifically, one end of an optical fiber 52 is secured to a sensor mounting window 51 provided in the furnace 1, and the photosensor 50 is secured to the other end of the optical fiber 52. This structure prevents thermal breakdown of the photosensor 50. As the photosensor 50, for example, a photodiode or a phototransistor is used to convert vibration of light in the flame 3 into an electric signal.

The photosensor 50 is connected to an amplifier 6 which amplifies the electric signal output from the photosensor 50. The circuit following the amplifier 6 is the same as that in the embodiment shown in FIG. 23. In this modification, when the burner 2 generates a flame 3, the photosensor 50 detects vibration of light in the flame 3, converts it into an electric signal and inputs it to the amplifier 6. The signal processing procedure carried out after the amplifier 6 is the same as in the embodiment shown in FIG. 23.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A combustion control apparatus for a burner comprising:

a photosensor for detecting a light power signal from a flame generated from the burner;

a low-pass filter for cutting off a component of the light power signal detected by said photosensor which is above a specific frequency to obtain a low-frequency light power signal;

a frequency analyzer for frequency-analyzing the low-frequency light power signal obtained through said low-pass filter to obtain a power spectrum;

arithmetic means for computing an integral value of said power spectrum in the entire frequency band and an integral value of said power spectrum in a frequency band above a preset reference frequency, computing a power spectrum integral ratio from these integral values, comparing the power spectrum integral ratio with a reference integral ratio previously set in correspondence with each particular excess air ratio, and outputting data representative of the result of the comparison; and air flow control means for controlling an air supply control valve of said burner on the basis of said comparison data.

2. A combustion control apparatus for a burner comprising:

a detector for detecting an ionic current in a flame from the burner or light power of the flame, which changes in accordance with a change of combustion condition of the flame, and outputting an electric signal corresponding to the detected ionic current or light power;

an amplifier for amplifying said electric signal;

a low-pass filter connected to the output side of said amplifier to remove a high-frequency component in said electric current, said low pass filter including a first and second output branch line;

a first circuit connected to the first output branch line of said low-pass filer to rectify the signal current having passed through said low-pass filter and thereby obtain a signal current in the form of a direct current;

a high-pass filter connected to the second output branch line of said low-pass filter to remove a low-frequency component in the signal current having passed through said low-pass filter;

a second circuit connected in the second output branch line to rectify the signal current having passed through said high-pass filter and thereby obtain a signal current in the form of a direct current;

an arithmetic unit connected to the output sides of said first and second branch lines to arithmetically determined a relation of the signal current in a specific frequency band to the signal current in the entire frequency band; and a combustion controller connected to the output side of said arithmetic unit to affect combustion control on the basis of the output from said arithmetic unit.

* * * * *

UNITED STATES PATENT AND TRADEMARK OFFICE

CERTIFICATE OF CORRECTION

PATENT NO. : 5,049,063

DATED : SEPTEMBER 17, 1991

INVENTOR(S) : Teruhiko KISHIDA et al.

It is certified that error appears in the above-identified patent and that said Letters Patent is hereby corrected as shown below:

Claim 2, column 14, line 43, change "determined" to --determine--.

Signed and Sealed this

Eleventh Day of August, 1992

*Attest:*

DOUGLAS B. COMER

*Attesting Officer*

*Acting Commissioner of Patents and Trademarks*